US010243299B1

(12) United States Patent
Krize et al.

(10) Patent No.: US 10,243,299 B1
(45) Date of Patent: Mar. 26, 2019

(54) ARTIFICIAL HOLIDAY TREE

(71) Applicant: Christmas Northeast, Inc., Trumbull, CT (US)

(72) Inventors: Anthony Krize, Redwood City, CA (US); Matthew Ryder, Attleboro, MA (US); James W. Gibboney, Jr., Suches, GA (US)

(73) Assignee: Christmas Northeast, Inc., Trumbull, CT (US)

( * ) Notice: Subject to any disclaimer, the term of this patent is extended or adjusted under 35 U.S.C. 154(b) by 0 days.

(21) Appl. No.: 16/214,969

(22) Filed: Dec. 10, 2018

Related U.S. Application Data

(63) Continuation-in-part of application No. 16/108,642, filed on Aug. 22, 2018, which is a continuation-in-part of application No. 15/658,471, filed on Jul. 25, 2017.

(51) Int. Cl.
*H01R 13/62* (2006.01)

(52) U.S. Cl.
CPC ..... *H01R 13/6205* (2013.01)

(58) Field of Classification Search
CPC ..... H01R 13/6205
See application file for complete search history.

(56) References Cited

U.S. PATENT DOCUMENTS 9,614,322 B1 * 4/2017 Gibboney, Jr. ..... H01R 13/64
9,899,813 B1 * 2/2018 Gibboney, Jr. ..... H02G 3/0487

* cited by examiner

*Primary Examiner* — Tho D Ta
(74) *Attorney, Agent, or Firm* — Nexsen Pruet, LLC; Michael A. Mann

(57) ABSTRACT

An artificial tree includes a base supporting a hollow trunk. The base includes plural legs connected to a central core. The base carries a housing containing an electrical controller for transforming, rectifying, and filtering electrical power received from a power receptacle. The housing includes a heat pump to dissipate heat from the electrical controller. A series of interconnected conduits comprises the tree trunk. A conduit has two identical electrical connectors that self-orient by magnetic repulsion to preserve electrical parity when connecting conduits together. Wiring harnesses run between the two electrical connectors in the conduit. The outside surface of the conduits carries hinge brackets to receive and pivotally hold artificial limbs. These limbs carry light strings and are pivotable between folded and deployed orientations. Wires from the wiring harness are pulled through holes in the sides of the conduits and connect to light strings on nearby limbs.

14 Claims, 13 Drawing Sheets

ARTIFICIAL HOLIDAY TREE

TECHNOLOGY FIELD

This disclosure relates to artificial holiday trees, particularly, artificial holiday trees that include lights.

BACKGROUND

Artificial trees such as those used for decorating during holidays have become more popular. These trees are increasingly more realistic-looking, that is, they look more like natural evergreen trees, than in the past. Artificial holiday trees may include lights, such as small incandescent lights or light-emitting diodes (LEDs). Tree lights may be arranged in an electrical series or in a series-parallel electrical configuration.

Despite progress, further improvements would be a benefit. Artificial holiday trees are stored when not in use and the act of packing a tree for storage and unpacking it can take its toll on the tree components. Lighting on trees tends to complicate both tree manufacturing and tree set up by the user. Additional refinements that simplify manufacturing and repair of damaged artificial holiday trees would be advantageous.

SUMMARY

Herein is disclosed an artificial tree that includes a base and a hollow trunk. The trunk is comprised of at least one conduit, and supported by the base. The tree includes artificial limbs that carry electrical lighting in the form of light strings. The lighting connects to electrical power carried by wiring within the hollow trunk. The tree limbs fold easily from a deployed position, wherein they extend generally radially, to a position nearly parallel with the trunk for storage, The limbs are held in hinge brackets by a pin, and may easily be removed from the hinge brackets by removing the pin first.

A feature of the disclosure is the artificial tree trunk, which has hinge brackets carried by the exterior surface of the artificial tree trunk to support the limbs. Limbs are secured within the hinge brackets by removable pins.

Still another feature of the disclosure is the electrical power connection and distribution system carried in the interior of the hollow trunk. This system includes electrical wiring connected to magnetic electrical connectors. Two such connectors, when joined in the correct orientation, pass electrical current. The magnets behind the conducting terminals push their respective terminal into an aperture in the magnetic electrical connector in response to magnetic attraction from an oppositely oriented, opposing magnet behind the terminal in a second magnetic electrical connector. The two terminals thus are moved into contact, urged by magnetic attraction of the magnets behind them, and pass electrical current for energizing the lighting on the limbs.

The artificial tree also has an electronic controller and a heat pump, both carried in the base, which controller and heat pump are also features of the disclosure. The electronic controller is connected between an electrical power source and the electrical power distribution system of the tree. The electronic controller conditions, regulates and controls electrical power delivered to the lighting on the artificial tree. The heat pump dissipates heat generated by the electronic controller through the base and the conduits that comprise the trunk, which are both thermally conductive. Heat dissipation is another feature of the disclosure.

The base itself has plural legs with surface-engaging feet and a framework made of solid and hollow heat-conducting material connected to a central core that attaches to the hollow trunk. The hollow trunk of the artificial tree may be made of conduits joined together frictionally, for example, by inserting the end of a first conduit into an end of a second conduit. The ends of a conduit may be reduced or expanded or a combination of both to facilitate joining two conduits frictionally. The base and the use of conduit sections are features of the disclosure.

Magnetic electrical connectors are used to transfer electricity from one conduit to the next. One magnetic electrical connector is at each of the ends of a conduit. One magnetic electrical connector of a conduit may be recessed from the end of the conduit and the other may be flush-mounted on the opposing end so the two magnetic electrical connectors readily move into electrical contact. A magnetic electrical connector flush-mounted at the end of a conduit is inserted into the end of the other conduit wherein a magnetic electrical connector is recessed so as to join the conduits frictionally and bring their magnetic electrical connectors into contact, according to features of the disclosure.

Still another feature of the disclosure is that the conduits comprising the trunk of the artificial tree may have holes formed in the walls of the conduits. The holes may be fitted with grommets so that a pair of electrical wires terminated in magnetic electrical connectors may extend through the hole in the conduit wall and be joined electrically to another magnetic electrical connector on the end of a light string on a limb to energize the lighting. The pair of wires are part of a wiring harness in the conduit that includes plural pairs of electric wire running from the magnetic electrical connector the first end of the conduit to the other magnetic electrical connector at the other end of the conduit. Particular pairs of wires in that harness will not be connected the second magnetic electrical connector and will exit holes in the side of that conduit to deliver electrical power to one of the light strings on a limb held in a hinge bracket by that conduit.

Many other features of the artificial tree disclosed herein will be apparent to those skilled in the art of artificial trees from a careful reading of the detailed description accompanied by the drawings.

BRIEF DESCRIPTION OF THE DRAWINGS

In the figures.

DETAILED DESCRIPTION

In the present disclosure, the terms "trunk" and "limbs" are sometimes used in connection with structures in an artificial tree 10 that are directly analogous to the trunk and limbs of a natural tree. For example, the word trunk will refer herein to at least one conduit. The word limb will refer to a metal or plastic representation of a real tree limb. Also, portions of the present disclosure incorporate components based on those disclosed in U.S. Pat. Nos. 9,899,813, 9,614,322 and U.S. patent application Ser. No. 16/205,961 filed Nov. 30, 2018; Ser. No. 16/108,642 filed Aug. 22, 2018, Ser. No. 15/899,722 filed Feb. 20, 2018, and Ser. No. 15/658,471 filed Jul. 25, 2017, all of which are incorporated in their entirety by reference.

This disclosure teaches an artificial tree 10, which is a manufacturable product made to simulate a natural tree in appearance. The present artificial tree 10 may be used, for example, during holidays, with lighting and ornamentation, such as a Christmas tree.

Figure 1:
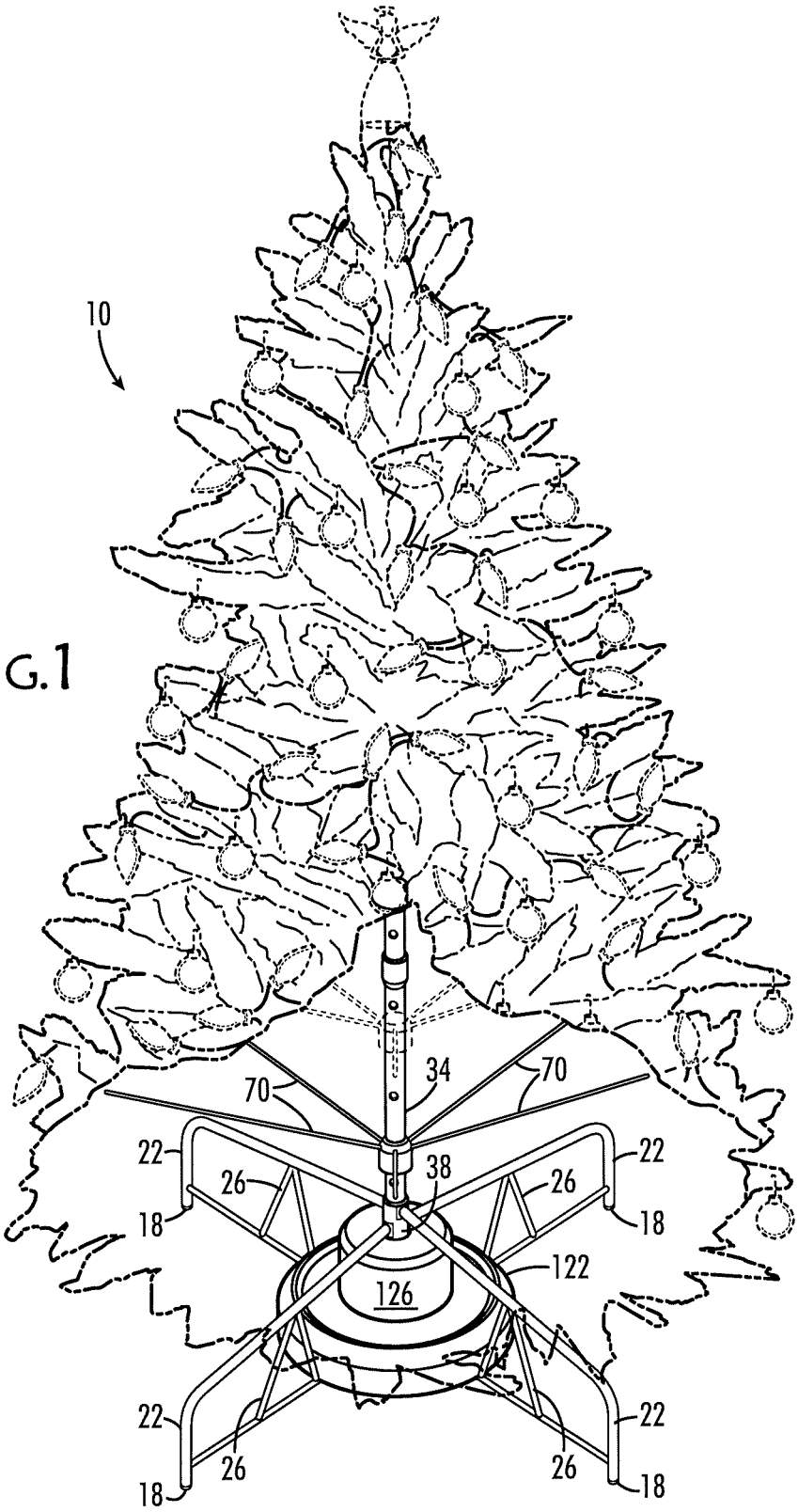
FIG. 1 is a perspective view of an artificial tree to show its base, heat pump, and trunk formed of joined conduits, according to an aspect of the disclosure.

Artificial tree 10 is illustrated in FIG. 1 and the details of artificial tree 10 are illustrated in FIGS. 2-5. Artificial tree 10 includes a base 14. The primary function of base 14 is to hold the artificial tree 10 in a vertical orientation, that is, in the orientation a natural tree would have grown.

Base 14 has an additional function, namely, heat dissipation. Base 14 may have legs 22 extending radially from a central core 38. Legs 22 may be solid or hollow members made of a material that is selected to have sufficient strength when formed into base 14 to hold artificial tree 10, including its ornaments and lights, in a stable, vertical orientation. The material may be also a good heat conductor, such as iron, steel, or aluminum, for example.

Figure 2:
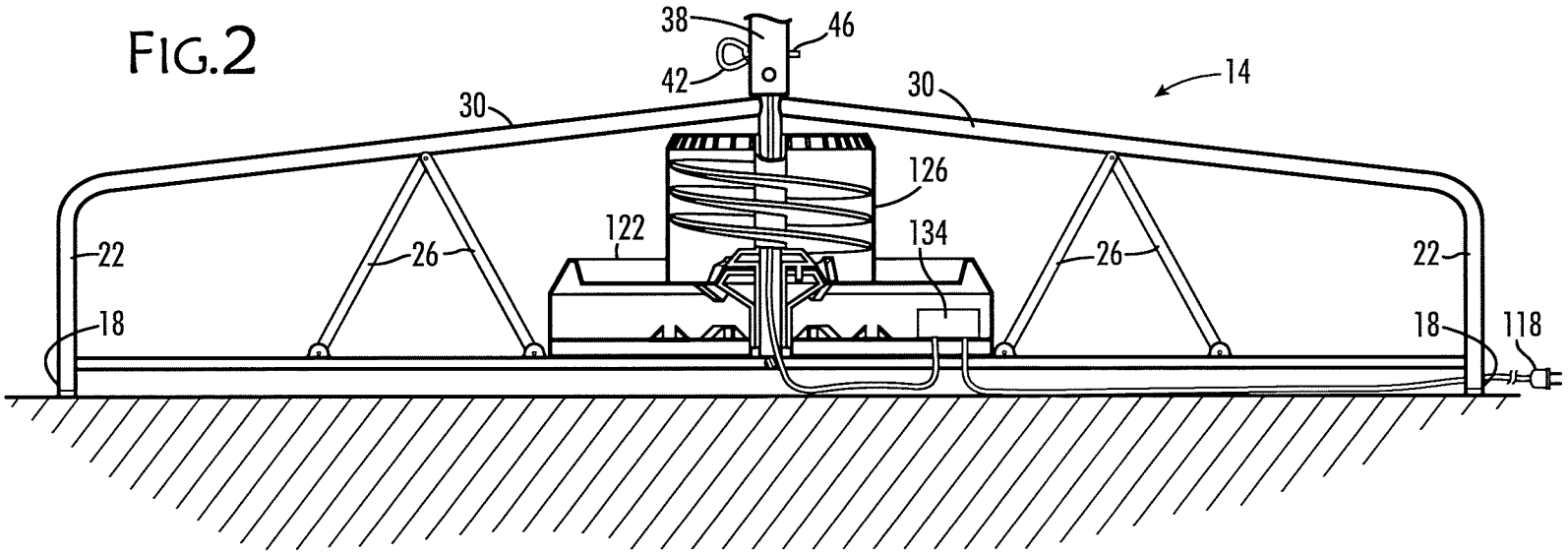
FIG. 2 is a side view of the base of FIG. 1 with the housing of the heat pump cutaway to show its interior and the electronic controller.

Base 14 also has surface-engaging feet 18 on the ends of leg 22. Legs 22 elevate other parts of the base 14 above the surface. Horizontal and diagonal braces 26, as best seen in FIG. 2, cooperate with upper supports 30 of legs 22 to provide support for tree 10.

The trunk 34 of artificial tree 10, which comprises at least one conduit 50, is received within central core 38 of base 14. Trunk 34 may be prevented from rotation with respect to central core 38 in any convenient manner. For example, a fastener 42, which may be a threaded eyebolt, may be inserted through a hole 46 formed in the wall of central core 38 and against trunk 34.

Trunk 34 of artificial tree 10 may, for example, comprise a conduit 50 for every meter of the height of artificial tree 10. Fastener 42 may engage the side of the first, or bottom-most, conduit 50 and extend through a hole 54 to secure central core 38 and conduit 50 together and prevent the latter from rotating.

Figure 3:
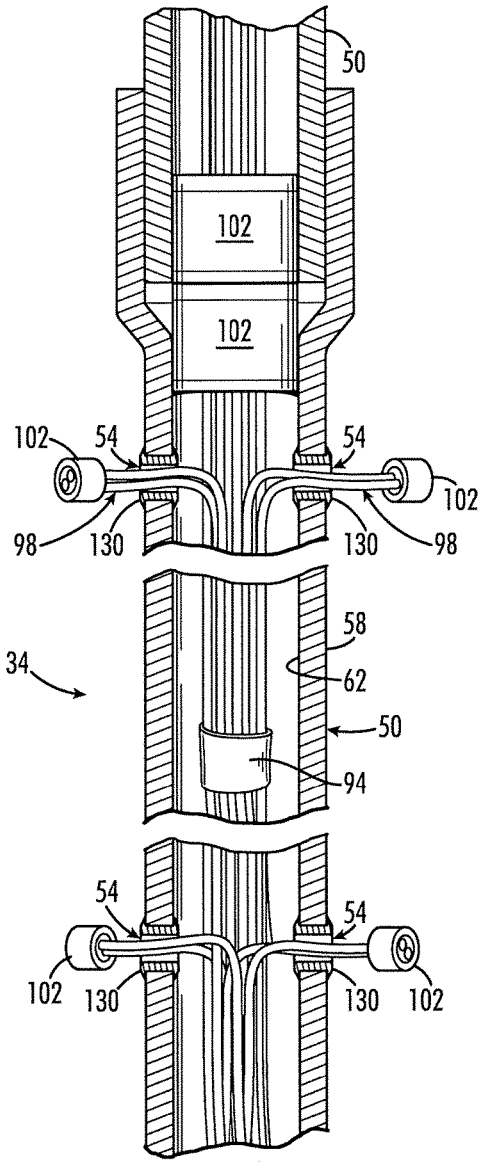
FIG. 3 is a cross-sectional view of portions of two conduits, the two conduits connected together frictionally and with their magnetic electrical connectors in contact and electrical wiring harnesses extending to those magnetic electrical connectors, according to an aspect of the disclosure.
Figure 4:
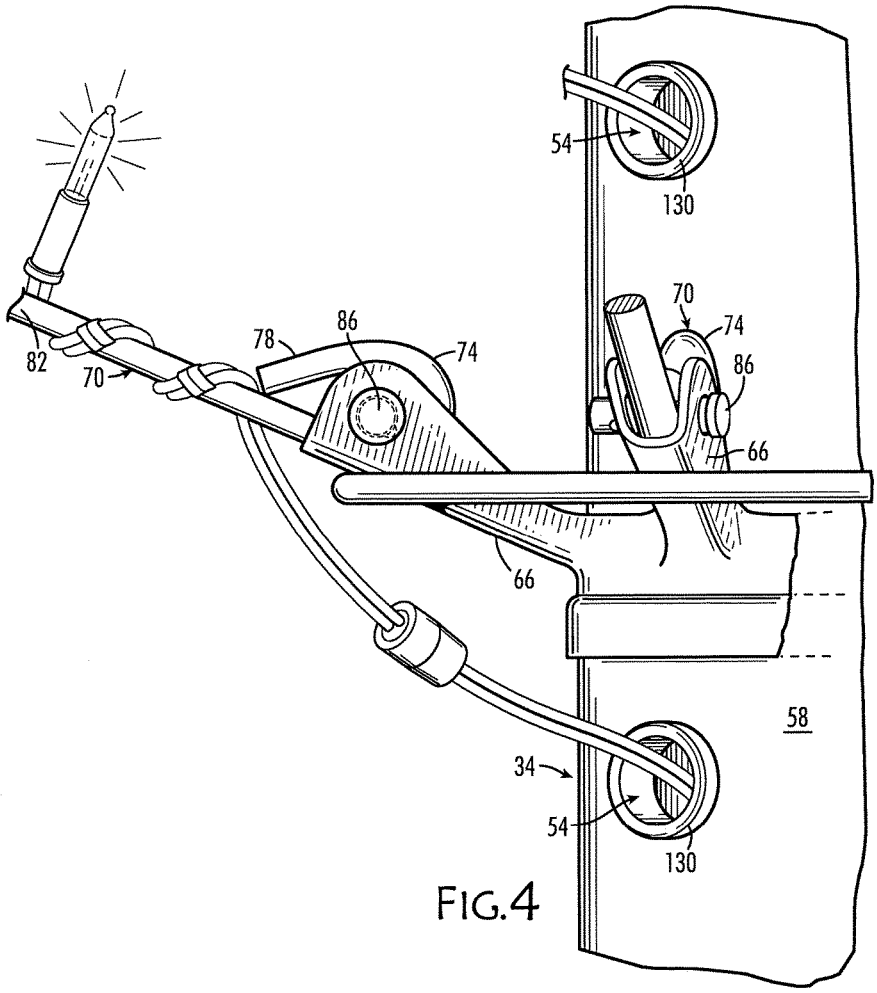
FIG. 4 is an exterior view of a tree trunk showing hinge brackets for holding limbs, one limb being shown in cross-section and a portion of another limb shown extending to the left, and showing a magnetic electrical connector extending through a hole in the conduit where it connects to with a corresponding magnetic electrical connector that leads to lighting on the tree limb.
Figure 5:
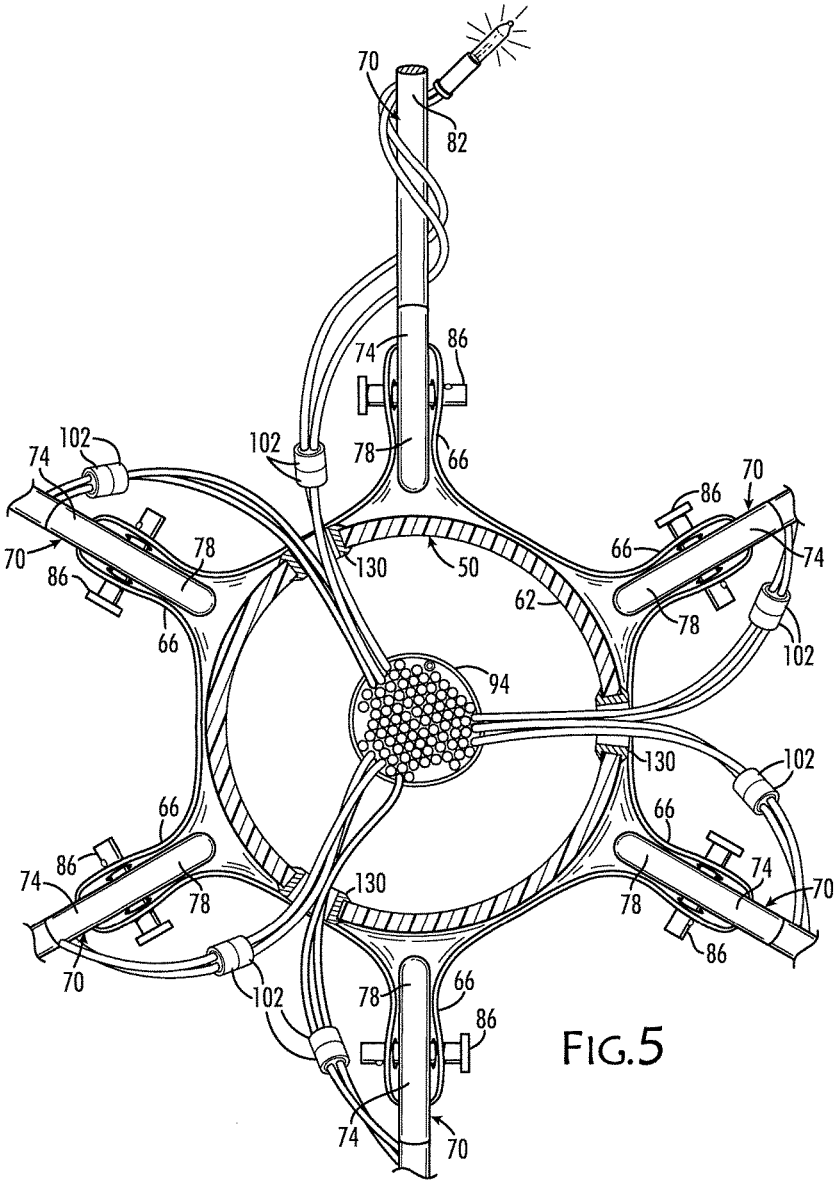
FIG. 5 is a top, cross-sectional view of a tree trunk conduit with six hinge brackets deployed to receive six limbs and with six sets of electrical conductors running from a harness in the center of the conduit and extending through one of six holes in the conduit wall to connect with light strings pre-strung on each of six limbs, according to an aspect of the disclosure.

Referring now to FIGS. 3, 4, and 5, hollow trunk 34 has an exterior surface 58 and an interior surface 62. On exterior surface 58, as shown in FIGS. 4 and 5, are hinge brackets 66. There may be several hinge brackets 66 attached to exterior surface 58 of conduit 50. Hinge brackets 66 may be arranged, for example, in clusters at different elevations on exterior surface 58 of conduit 50 to simulate natural evergreen limb growth, such as three to six hinge brackets 66 in a single cluster with three to five clusters per conduit 50.

Hinge bracket 66 receives a limb 70. Hinge bracket 66 enables limb 70 to rotate between a vertical orientation and a radial orientation, cantilevered with respect to trunk 34. Accordingly, hinge brackets 66 need to be strong enough and secured well enough to trunk 34 to hold limb 70 (plus lighting and decorations the user wishes to add to limb 70). Hinge bracket 66 may be curved to conform to the proximal end 74 of limb 70, which may have a circular cross section as seen in FIG. 4, so that limb 70 nests securely inside the curve of hinge bracket 66.

Limb 70 may include a loop 78 in its proximal end 74, which is the end that is closest to trunk 34 when limb 70 is inserted into hinge bracket 66; a distal end 82 of limb 70 will extend away from trunk 34 when limb 70 is in its cantilevered orientation. Hinge bracket 66, being curved to form two opposing sides of the curve, may receive a pin 86 passing through holes formed in hinge bracket 66 and through loop 78 which nests between the two sides of hinge bracket 66, thereby trapping limb 70 between the two sides of hinge bracket 66, and allowing limb 70 to pivot about pin 86. In that position, limb 70 is held securely to trunk 34 by hinge bracket 66 and limb 70 is otherwise free to pivot between a cantilevered position and its stored position nearly parallel to trunk 34 of artificial tree 10. The stored position may be suitable for storage and shipping of artificial tree 10 because of its more compact configuration.

As shown in FIG. 5, conduit 50 is generally cylindrical and may be secured, end-to-end, to another conduit 50. Conduit 50 may be secured by a coupling (not shown) that joins two conduits 50 or by inserting the end of conduit 50 into the expanded end of a next conduit 50, as shown in FIG. 3.

Conduit 50 contains two magnetic electrical connectors 102. Magnetic electrical connectors 102 are identical and self-orienting. The term "magnetic electrical connectors" is used herein to denote electrical connectors that pass electricity from one electrical conductor to another electrical conductor, and wherein magnetic electrical connectors use magnets to control movement of terminals. Only after magnetic electrical connectors 102 of two conduits 50 are properly oriented will magnetic electrical connectors 102 be able to make electrical connection because the magnets of opposing magnetic electrical connectors 102 will then be of opposite polarity and be magnetically attracted to each other. Magnetic electrical connectors, when so attracted, tend to move toward each other. The electrically conducting terminals are between them, when the magnetic electrical connectors are properly oriented, and are thus pushed together by the magnets responding to the magnetic attraction that are behind them.

As two conduits 50 are moved toward each other and rotated axially into position, the terminals of the two magnetic electrical connectors 102 remain inside their respective magnetic electrical connector 102. Once magnetic electrical connectors 102 are aligned, that is, their magnets are oriented with opposite polarity so they attract, the magnetic electrical connectors are urged into electrical contact, as will be described more fully below.

A wiring harness 94 connects to a pair of magnetic electrical connectors 102 inside conduit 50, as best seen in FIGS. 3, 4, and 5. Wiring harness 94 will include pairs of wires 98 that run from one magnetic electrical connector 102 to another magnetic electrical connector 102 at the opposing end of the same conduit 50, and may also include pairs of wires 98 that terminate in magnetic electrical connector 102 outside conduit 50. A magnetic electrical connector 102 may be connected to a pair of wires 98 that have been pulled through a hole 54 formed in the side of conduit 50 where wires 98 and their magnetic electrical connector 102 remain until used for powering the lights of a limb 70. Hole 54 may be fitted with a grommet 130 to protect wires 98 from the thin edge of hole 54 of conduit 50.

Alternatively, more than one pair of wires 98 may extend through hole 54. For example, there may be three holes 106 in conduit 50, with two paired sets of wires 98 running through each of the three holes 106, or, alternatively, three paired sets of wires 98 running through two holes 106 in conduit 50. Alternatively, one hole 54 may be provided with one set of wires 98 going to a light string 114 on a first limb 70 (best seen in FIG. 4), and that set of wires 98 may be connected to a jumper wire 110 that runs to a second limb 70, and to additional jumper wires 110 running to the remaining limbs 70 of that cluster. Accordingly, lights of limb 70 may receive primary power and the rest of the lights on the other limbs 70 in that cluster would be connected in an electrical series/parallel arrangement. Lights of limb 70 may then be connected in parallel with the lights of the next limb 70 in the cluster. The lights on limbs 70 of other clusters would be in series with those limbs 70 of the first cluster of the series. Wiring may thus be reduced, which results in reduced manufacturing cost.

The exterior surface 58 of conduits 50 carry hinge brackets 66 that receive limbs 70. Limbs 70 may be pre-wired for lighting 114, which lighting terminates in a magnetic electrical connector 102 near hinge bracket 66. A magnetic electrical connector 102 on the ends of the wires 98 running from inside conduit 50 may be connected to another magnetic electrical connector 102 on the end of another group of wires from a light string set (not shown) on limb 70 of artificial tree 10 to power that light string.

Magnetic electrical connectors 102 may be those shown and described herein. Light string on limb 70 may terminate in a magnetic electrical connector 102. Hinge cluster may have wires 98 that terminate in the same type of magnetic electrical connector 102 and which can be then be connected to another such magnetic electrical connector 102 on the end of the pair of wires coming through hole 54 in conduit 50 from wiring harness 94. When magnetic electrical connectors 102 are used, where there is one magnetic electrical connector 102 per limb 70, then limb 70 would have its own separable lighting system.

Additionally, these magnetic electrical connectors 102 are easily disconnected. Here, hinge bracket 66 has a pin 86 that passes through loop 78. By pulling pin 86 from hinge bracket 66, limb 70 may be removed. As limb 70 is removed, magnetic electrical connector 102 self-disconnects from the corresponding magnetic electrical connector 102 that runs from wiring harness 94 in conduit 50. Moreover, in the event the lights on limb 70 or other aspect of limb 70 fail or break, the entire artificial tree 10 need not be replaced. Instead, only the affected limb 70 is replaced. The limb 70 provided in replacement may then be slid into hinge bracket 66 and pin 86 inserted to hold it. Then, the magnetic electrical connector 102 from limb 70 is connected to magnetic electrical connector 102 from conduit 50.

At the bottom of the artificial tree 10, running into the base 14, is an electrical power connection, such as a plug 118 that is insertable into a wall socket to access commercial or residential power, for example, 115 VAC, to deliver electrical power to an electrical controller inside a housing 122 of a heat pump 126. Inside the base 14 is an electronic controller 134 that may transform, rectify, and filter the electric power so that direct current of the appropriate voltage is passed to a magnetic electrical connector 102 (not shown) in the lower-most conduit 50 where electrical current is carried to the light strings on limbs 70 of artificial tree 10.

Heat generated by electronic controller 134 is dissipated vertically by heat pump 126, which directs the heated air up through housing 122 and on to conduits 50. Heat also radiates through the housing 122 and the legs 22 of base 14, which run through housing 122. The operation of heat pump 126 is disclosed and described in more detail and described in U.S. Pat. No. 9,033,777.

Figure 6:
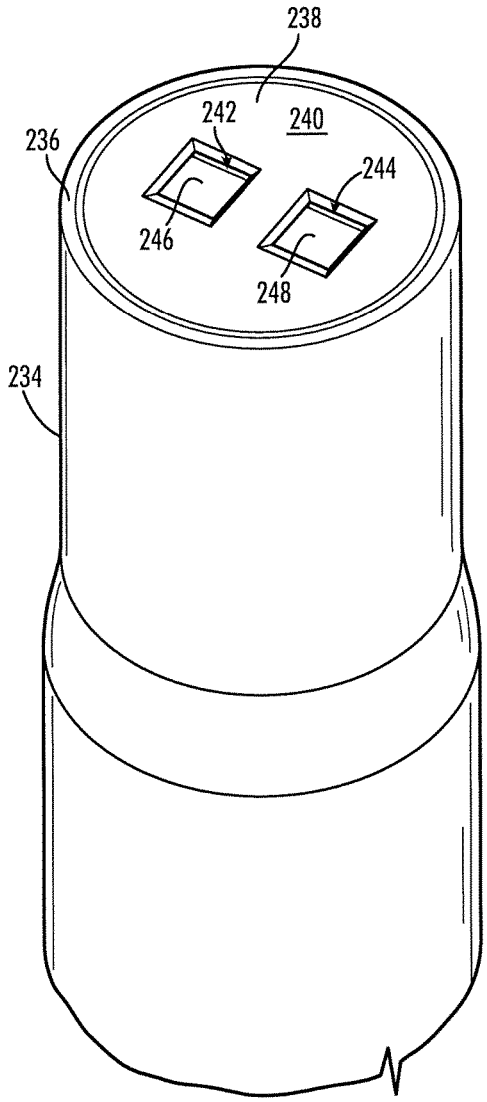
FIG. 6 is a perspective, first end view of a conduit with magnetic electrical connector flush-mounted in the reduced-diameter end of the first end of the conduit and showing its two electrical contacts, according to an aspect of the disclosure.

FIG. 6 shows a perspective view of a first conduit 234. First conduit 234 has a first end 236 that is reduced in diameter from the diameter of the balance of first conduit 234. A first magnetic electrical connector 238 is mounted in first end 236 of first conduit 234 so that a top surface 240 is flush with first end 236. A first aperture 242 and a second aperture 244 are formed in first magnetic electrical connector 238 where a portion of a first terminal 246 and a portion of a second terminal 248 can be seen.

Figure 7:
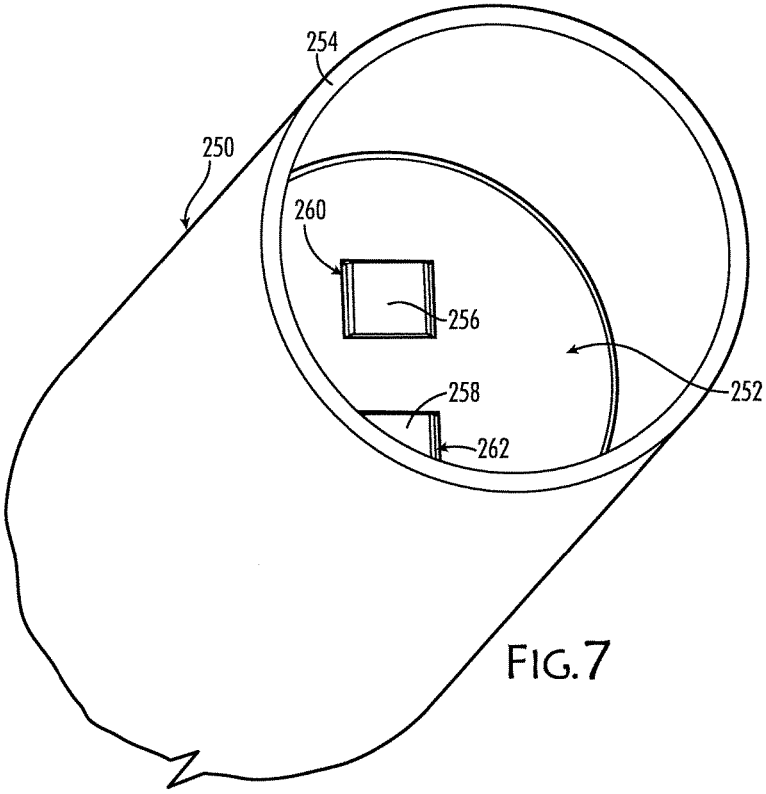
FIG. 7 is a perspective, second end view of the opposing end of the conduit shown in FIG. 6, with a magnetic electrical connector recessed deep into the conduit, and which magnetic electrical connector is the same as that shown in FIG. 5, according to an aspect of the disclosure.

FIG. 7 shows a perspective view of a second conduit 250, which also has a first end 254. Unlike first conduit 234, wherein first end 236 has a reduced diameter, first end 254 of second conduit 250 has a diameter that is not reduced (or enlarged). First end 236 of first conduit 234 is dimensioned to be received inside first end 254 of second conduit 250.

A second magnetic electrical connector 252 is mounted inside of second conduit 250, recessed below first end 254. Second magnetic electrical connector 252 carries a third terminal 256 and a fourth terminal 258 seen through third aperture 260 and fourth aperture 262, respectively.

Figure 8:
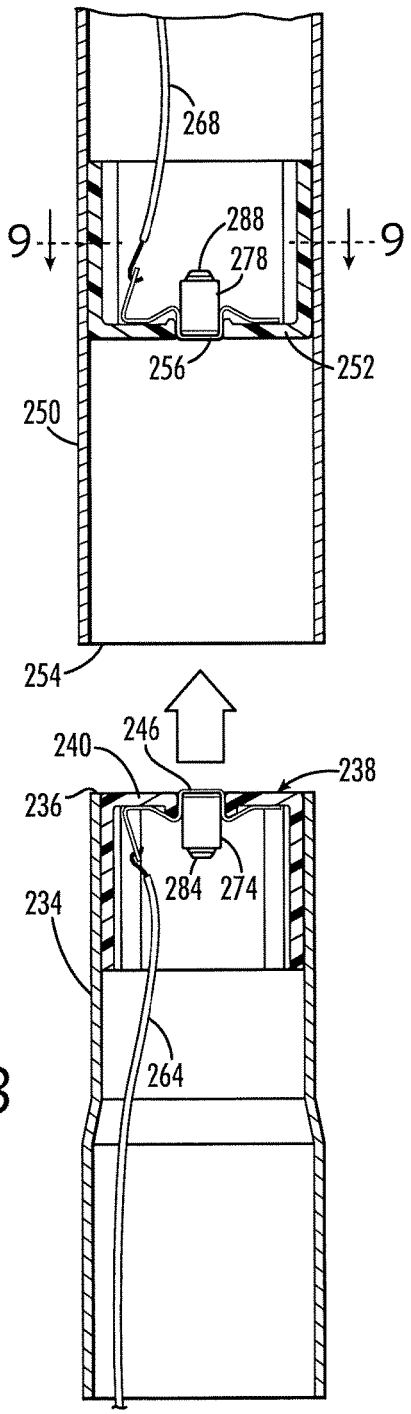
FIG. 8 is a side cross-sectional view of two magnetic electrical connectors, of the type shown in FIGS. 3, 6 and 7, in conduits, with the upper one recessed as shown in FIG. 7 and the lower one flush-mounted as shown in FIG. 6, and the two conduits shown as if moving together, according to an aspect of the disclosure.

As illustrated in FIG. 8, which is a cross-sectional, side view of first conduit 234 and, above it, second conduit 250, which is inverted, as if about to be joined together. First magnetic electrical connector 238 is also rotated so that first terminal 246 is toward the viewer and hides second terminal 248 behind it. Second magnetic electrical connector 252 is also rotated so that third terminal 256 is toward the viewer and fourth terminal 258 is hidden behind it with respect to the viewer.

As first end 236 of first conduit 234 is inserted into first end 254 of second conduit 250, and first magnetic electrical connector 238 is brought into engagement with second magnetic electrical connector 252, first terminal 246 may be aligned with third terminal 256 and second terminal 248 may be aligned with fourth terminal 258. First end 236 of first conduit 234, with its reduced diameter, fits into first end 236 of second conduit 250, so as to enable the flush-mounted first magnetic electrical connector 238 to engage the recessed second magnetic electrical connector 252. An electrical connection is then obtained between a first wire 264 and first terminal 246 and a third terminal 256 and third wire 268. Not visible in FIG. 8 is another electrical connection between a second wire 266, a second aperture 244, a fourth terminal 258 and a fourth wire 270.

Additionally, a first magnet 274 and a third magnet 278 are visible in FIG. 8 and a second magnet 276 and a fourth magnet 280 are located behind first magnet 274 and third magnet so they are not visible in FIG. 8 and are obscured by first magnet 274 and third magnet 278.

Figure 9:
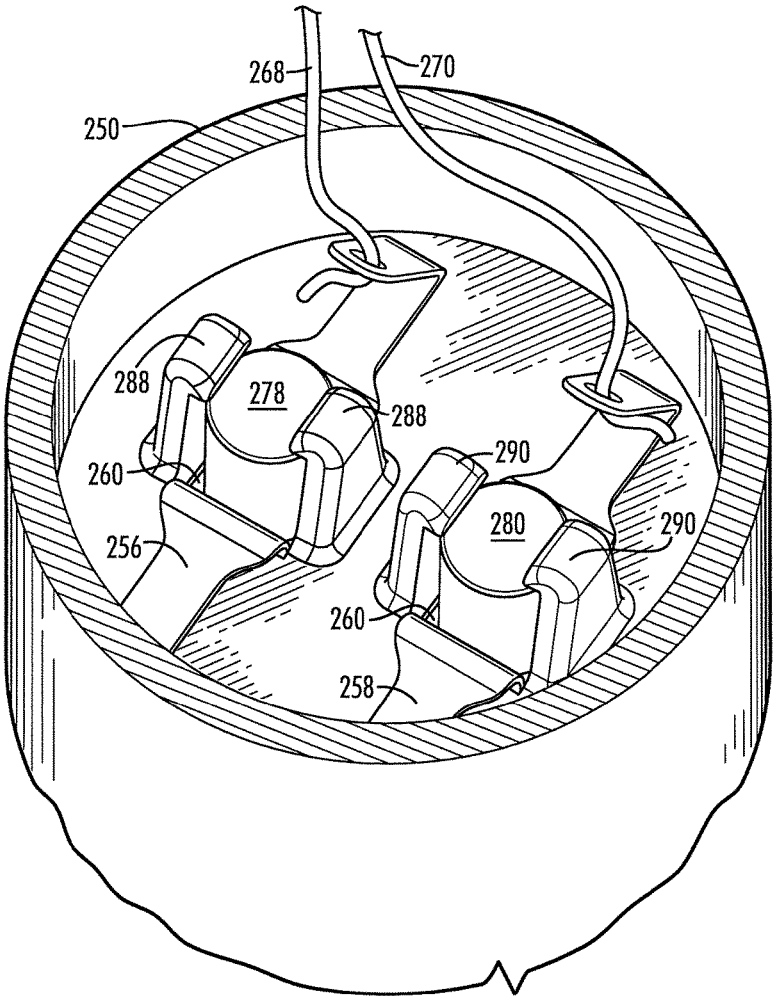
FIG. 9 is a perspective, inside view of the two electrical terminals of a magnetic electrical connector showing the magnets and the conductive terminals, according to an aspect of the disclosure.

FIG. 9 is a partial cross-sectional, perspective view of second magnetic electrical connector 272, which is at the top in FIG. 8. FIG. 9 shows conduit 250 and second magnetic electrical connector 252 in the same orientation as in FIG. 8 and in a top perspective view.

A third wire 268 and a fourth wire 270 are connect to third terminal 256 and fourth terminal 258, respectively, and run to first terminal 246 and to second terminal 248, respectively, and continue on to first wire 264 and second wire 266, respectively. Third terminal 256 runs under third magnet 278; fourth terminal 258 runs under a fourth magnet 280. Third terminal 256 is formed to seat in third aperture 260 so that it spans third aperture 260 and stays centered over third aperture 260; fourth terminal 258 is formed to seat in fourth aperture 262 in a similar manner as is first terminal 246 in first aperture 242 and second terminal 248 in second aperture 244. First terminal 246, second terminal 248, third terminal 256 and fourth terminal 258 may be made of a resilient conductor such as a conductive metal like copper or brass. First terminal 246, second terminal 248, third terminal 256 and fourth terminal 258 are bent and has a small hole formed therein to facilitate connection to first wire 264, second wire 266, third wire 268 and fourth wire 270, respectively, and to hold first magnet 274, second magnet 276, third magnet 278 and fourth magnet 280 in first aperture 242, second aperture 244, third aperture 260 and fourth aperture 262.

Figure 10:
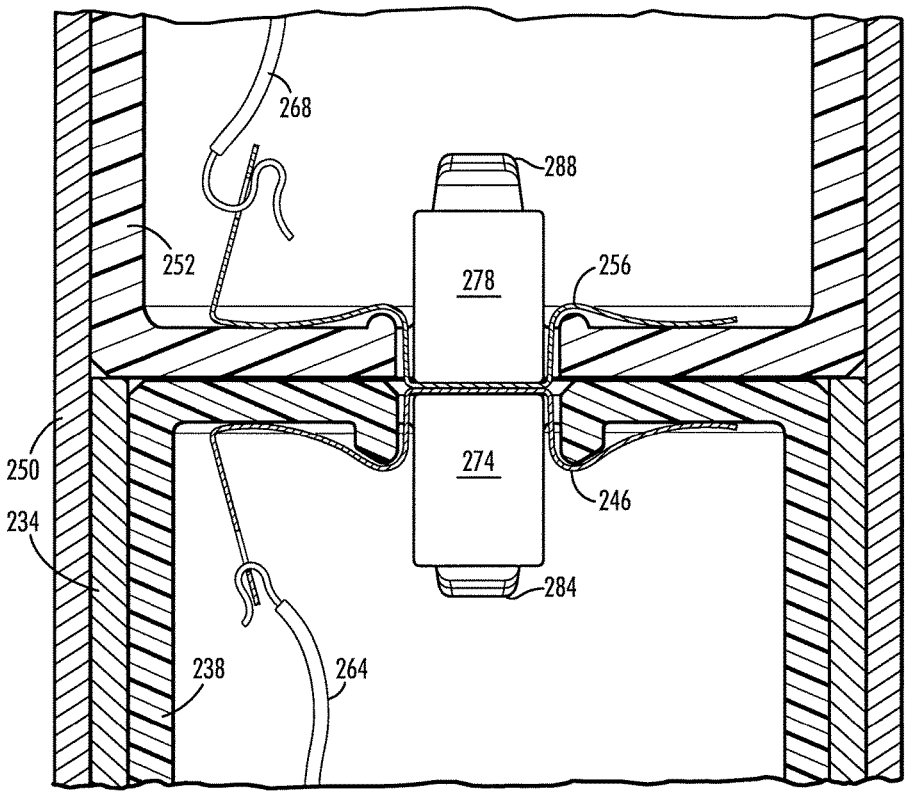
FIG. 10 is a partial side view, in cross-section, of two joined conduits of FIG. 8 with their respective magnetic electrical connectors in electrical contact with each other when the magnetic electrical connectors are properly oriented, according to an aspect of a disclosure.

As seen in FIG. 10, which shows first magnetic electrical connector 238 in engagement with second magnetic electrical connector 252. In FIG. 10, first magnet 274 and third magnet 278 are oriented so that the facing poles are magnetically attractive. Consequently, magnetic attraction forces between first magnet 274 and third magnet 278 force first terminal 246 and third terminal 256, which are between first magnet 274 and third magnet 278, into contact so that an electric current in first wire 264 can pass through first terminal 246, third terminal 256, and on to third wire 268. Similarly, in the orientation shown in FIG. 10, second magnet 276 and fourth magnet 280, which are obscured by first magnet 274 and third magnet 278, will also attract and push second terminal 248 and fourth terminal 258 together so electricity can flow from second wire 266 and fourth wire 270.

Figure 11:
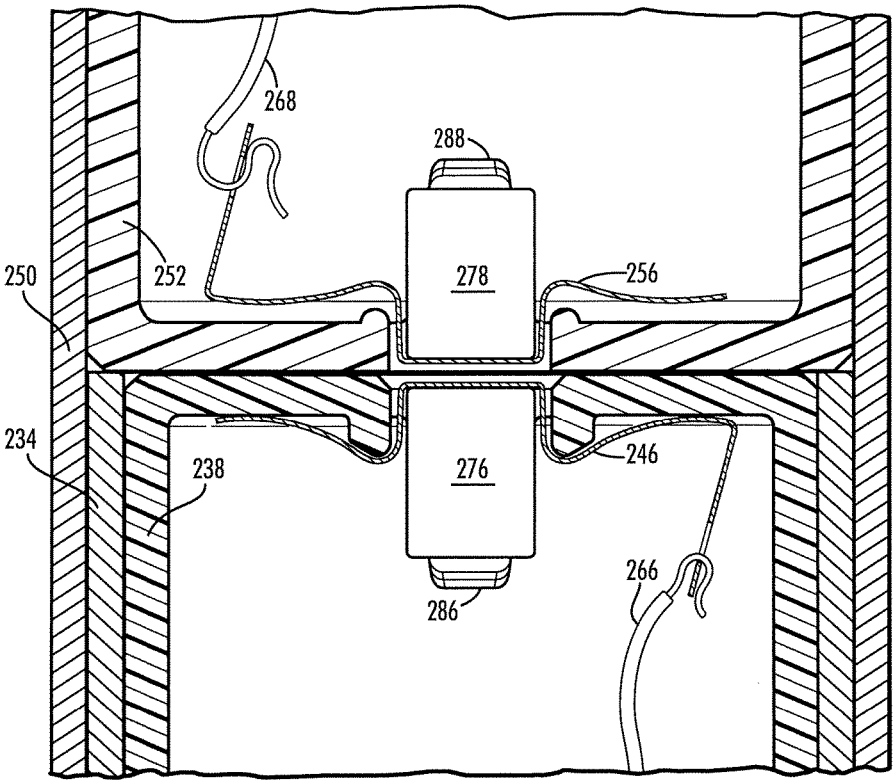
FIG. 11 is the same partial side, cross-sectional view of two conduits as shown in FIG. 10, and with the magnetic electrical connectors not in electrical contact when the magnetic electrical connectors are not properly oriented, according to an aspect of the disclosure.

As seen in FIG. 11, if first magnetic electrical connector 238 and second magnetic electrical connector 252 are oriented as shown in FIG. 11, then first magnet 274 is opposite fourth magnet 280, and second magnet 276 is opposite third magnet 278. The orientation of first magnet 274 and fourth magnet 280 are such that they repel, as will second magnet 276 and third magnet 278. According, first terminal 246 and fourth terminal 258 will remain apart, and second terminal 248 and third terminal 256 will not be in contact, so electricity cannot flow from first wire 264 to fourth wire 270 and from second wire 266 to third wire 268.

Limiting movement of first magnet 274, second magnet 276, third magnet 278 and fourth magnet 280 when responding to magnetic repulsion (or gravity) are first posts 284, second posts 286, third posts 288, and fourth posts 290, shown in FIGS. 9, 10, and 11, with third posts 288 and fourth posts 290 best seen in detail in FIG. 9. Posts comprise pairs of posts, so first posts 284 comprise two posts; second posts 286 comprise two posts, etc. First magnet 274 is prevented from moving too far by first posts 284; second magnet 276 is prevented by second posts 286; third magnet 278 is prevented by third posts 288; and fourth magnet 280 is prevented from moving too far by fourth posts 290.

Figure 12A:
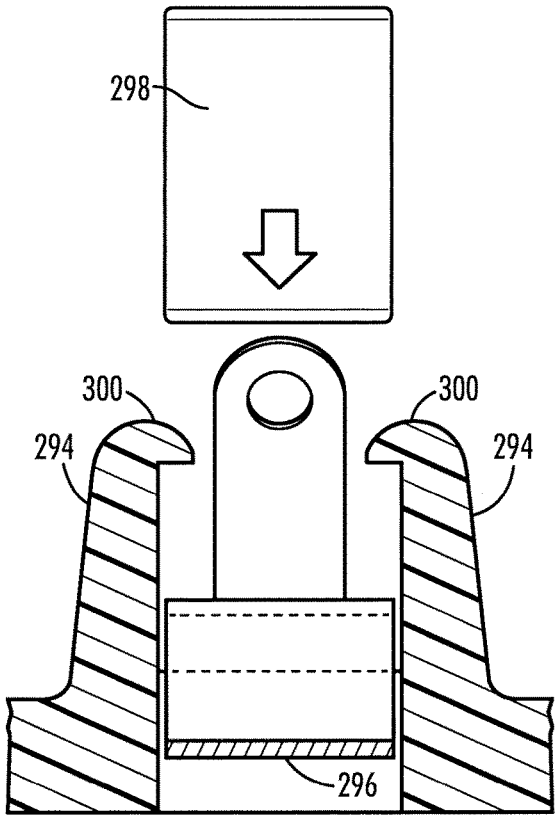
FIGS. 12A, 12B, and 12C comprise a sequence of cross-sectional side views of a magnet being inserted between two keepers according to an aspect of the disclosure, wherein the magnet comes into the position where it will control the movement of the terminal it is associated with, that is, holding the terminal in the aperture for contact with an opposing terminal when the magnetic electrical connectors are properly aligned, and not urging the terminal into the aperture when the two magnetic electrical connectors are not properly aligned, according to an aspect of the disclosure.
Figure 12B:
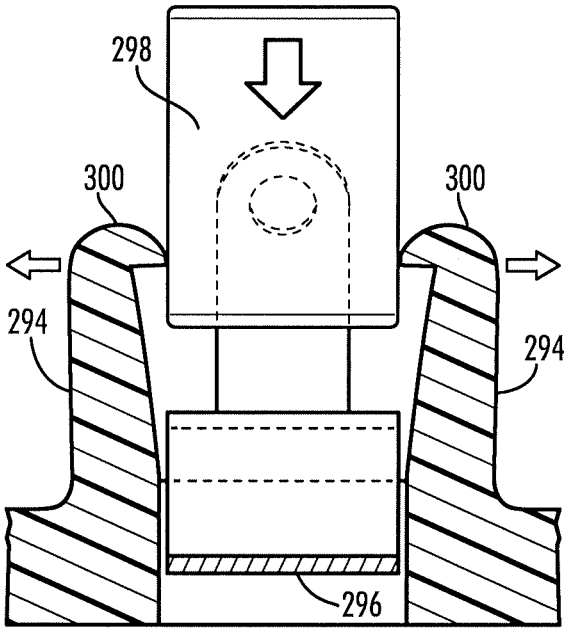
Figure 12C:
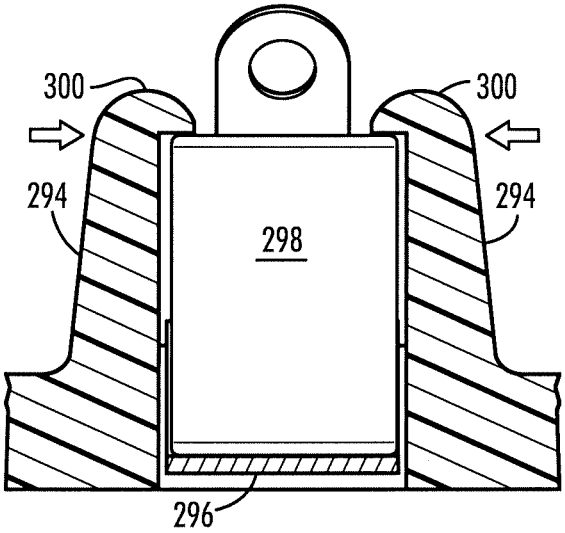

FIG. 12A shows posts 294 and a terminal 29. Posts 294 are made of a flexible, resilient material such as a plastic. FIG. 12B shows posts 294 with terminal 296 and with a magnet 298 partially inserted between posts 294. FIG. 12C shows posts 294 with terminal 296 and magnet 298 seated on terminal 296 and in place between posts 294. Curved portion 300 on posts 294, on the insertion of magnet 298, close over magnet 298 to prevent its removal.

Accordingly, magnets by their orientation and by the magnetic attraction and repulsion forces operate as switches to open or close circuits depending on the orientation of first and second magnetic electrical connectors by pushing terminals together or leaving them apart. They can therefore preserve polarity of direct current sources to the direct current loads.

Conduits, such as conduits shown herein may also carry internal controllers, power modifiers, and safety monitors, such as ground fault interrupters. These additional electrical devices may be installed in conduits described herein to meet general requirements based on safety regulations or specific needs. Accordingly, whenever new safety regulations are required, conforming to those requirements may be much easier with the present electricity access system.

Conduits may be made out of most any material that will work within the specified application and regulatory requirements. Conduits may be cylindrical and they otherwise are made to meet or exceed to applicable standards.

The present magnetic repulsion/attraction-based electrical access system connects automatically once workers bring the magnetic electrical connectors into proximity. It may reduce the cost of installing electrical, multiline phone systems, burglary systems, cable systems, paging systems, zonal sounds systems, cable antenna driver systems, local repeaters, intercom systems, instrument control systems, zonal air conditioning controllers and thermostats.

Because of their universal nature, general purpose conduits may be made in standard lengths (such as 6", 12", 18", 24", 30", 36", 48", 5', 10' sections) with short, dedicated inline taps for accessing AC power USB ports, networking connections, monitors, televisions, radios; night lights, counter lighting, under counter lighting, dedicated pole lights, etc.

Those skilled in the art of the installation and deployment of electrical devices and appliances in buildings, shelters, and homes will appreciate that many modifications and substitutions may be made in the foregoing description of aspects of the disclosure.

What is claimed is:

1. A device, comprising:

(a) a base;

(b) a conduit supported by said base, said conduit having an interior surface and an exterior surface;

(c) electrical lighting carried by said exterior surface of said conduit;

(d) a first magnetic electrical connector carried by said interior surface of said conduit, said first magnetic electrical connector including a first terminal, a second terminal, a first magnet, and a second magnet;

(e) a first wire and a second wire running to said first magnetic electric connector from said base and through said conduit, said first wire and said second wire operable to deliver an electric current to said first magnetic electrical connector; and (f) a second magnetic electrical connector operably connected to said electrical lighting, wherein said second magnetic electrical connector includes a third terminal, a fourth terminal, a third magnet, and a fourth magnet, and wherein, when said first magnetic electrical connector faces said second magnetic electrical connector and said first terminal and said third terminal are positioned between said first magnet and said third magnet, said second terminal and said fourth terminal are positioned between said second magnet and said fourth magnet, and said first magnet attracts said third magnet and said second magnet attracts said fourth magnet, said first magnet and said third magnet move said first terminal and said third terminal into contact, and said second magnet and said fourth magnet move said second terminal and said fourth terminal into contact, wherein electrical current flows from said first magnetic electrical connector through said second magnetic electrical connector to said electric lighting.

2. The device of claim 1, wherein when said first terminal faces said fourth terminal and said second terminal faces said third terminal, said first magnet and said fourth magnet repel, said second magnet and said third magnet repel, said first terminal does not move into contact with said fourth terminal, and said second terminal does not move into contact with said third terminal, and wherein said second magnetic electrical connector does not pass an electrical current from said first magnetic electrical connector to said electrical lighting.

3. The device of claim 1, further comprising an electrical controller carried by said base and operable to connect to a source of an electrical current, said electrical rectify operable to modify said electrical current to light said electrical lighting.

4. The device of claim 1 further comprising:

(a) a heat pump carried by said base; and (b) an electrical controller carried by said base and operable to conduct an electrical current, said electrical controller operable to modify said electrical current to light said electrical lighting, said heat pump dissipating heat produced by said electrical controller.

5. The device of claim 1, further comprising (a) a hinge carried by said conduit; and (b) a limb carried by said hinge, said hinge operable pivot said limb between a stored position and a deployed position.

6. The device of claim 1, wherein said first terminal is made of electrically conducting material, and said second terminal is made of electrically conducting material.

7. The device of claim 6, wherein said first terminal and said second terminal are made of resilient metal.

8. The device of claim 6, wherein said first magnetic electrical connector has a first aperture and a second aperture formed therein, said first terminal being positioned at said first aperture, and said second terminal being positioned at said second aperture, and wherein said second magnetic electrical connector has a third aperture and a fourth aperture formed therein, said third terminal being positioned at said third aperture, and said fourth terminal being positioned at said fourth aperture.

9. The device of claim 8, wherein said first magnet controls movement of said first terminal at said first aperture and said second magnet controls movement of said second terminal at said second aperture.

10. The device of claim 8, wherein said first magnetic electrical connector has a first post and a second post, said first post limiting movement of said first terminal away from said first aperture and said second post limiting movement of said second terminal away from said second aperture.

11. An artificial tree, comprising:

(a) a base;

(b) a first conduit supported by said base;

(c) at least one limb supported by said first conduit;

(d) a light string carried by said limb, (e) an electrical conductor running from said base into said first conduit, said electrical conductor having a first end at said base and a second end in said first conduit;

(f) a first magnetic electrical connector carried inside said first conduit, said first magnetic electrical connector including a first terminal, a second terminal, a first magnet, and a second magnet;

(g) a first wire and a second wire of said second end of said electrical conductor running to said first magnetic electric connector from said first end of said electrical conductor and through said first conduit, said first wire and said second wire operable to deliver an electric current to said first magnetic electrical connector; and (h) a second magnetic electrical connector operably connected to said light string, wherein said second magnetic electrical connector includes a third terminal, a fourth terminal, a third magnet, and a fourth magnet, and wherein, when said first magnetic electrical connector faces said second magnetic electrical connector and said first terminal and said third terminal are positioned between said first magnet and said third magnet, said second terminal and said fourth terminal are positioned between said second magnet and said fourth magnet, and said first magnet attracts said third magnet and said second magnet attracts said fourth magnet, said first magnet and said third magnet move said first terminal and said third terminal into contact, and said second magnet and said fourth magnet move said second terminal and said fourth terminal into contact, wherein electrical current flows from said first magnetic electrical connector through said second magnetic electrical connector to said light string.

12. The artificial tree of claim 11, wherein when said first terminal faces said fourth terminal and said second terminal faces said third terminal, said first magnet repels said fourth magnet, said second magnet repels said third magnet repel, said first terminal does not move into contact with said fourth terminal, and said second terminal does not move into contact with said third terminal, and wherein said second magnetic electrical connector does not pass electrical current from said first magnetic electrical connector to said light string.

13. The artificial tree of claim 11, further comprising a second conduit, said second conduit being between said base and said first conduit, said first conduit having a first end and an opposing second end, wherein a third magnetic electrical connector is carried by said second end of said first conduit, and wherein a fourth magnetic electrical connector is carried by said first end of said second conduit.

14. The artificial tree of claim 13, wherein said electrical conductor further comprises a first electrical conductor and a second electrical conductor, said first electrical conductor running from said first end of said electrical conductor to said fourth magnetic electrical connector and said second electrical conductor running from said third electrical connector to said first magnetic electrical connector.

* * * * *